United States Patent [19]

Polk et al.

[11] Patent Number: 4,630,298

[45] Date of Patent: Dec. 16, 1986

[54] METHOD AND APPARATUS FOR REPRODUCING SOUND HAVING A REALISTIC AMBIENT FIELD AND ACOUSTIC IMAGE

[76] Inventors: Matthew S. Polk, 305 Tuscany Rd., Baltimore, Md. 21210; Colin B. Campbell, 3600 Elkader Rd., Baltimore, Md. 21218

[21] Appl. No.: 739,452

[22] Filed: May 30, 1985

[51] Int. Cl.[4] ..... H04R 5/00

[52] U.S. Cl. ..... 381/1; 381/24

[58] Field of Search ..... 381/1, 24, 99, 100, 381/17

[56] References Cited

U.S. PATENT DOCUMENTS

| | | | |
|---|---|---|---|
| 4,308,423 | 12/1981 | Cohen | 381/24 |
| 4,355,203 | 10/1982 | Cohen | 381/1 |
| 4,489,432 | 12/1984 | Polk | 381/24 |
| 4,497,064 | 1/1985 | Polk | 381/24 |
| 4,569,074 | 2/1986 | Polk | 381/1 |

*Primary Examiner*—Forester W. Isen

*Attorney, Agent, or Firm*—Cushman, Darby & Cushman

[57] ABSTRACT

Apparatus for reproducing sound having a realistic ambient field and acoustic image is used in a stereophonic sound reproduction system having a left channel output and a right channel output. A right main speaker and a left main speaker are disposed at right and left main speaker locations, respectively, which are equidistantly spaced from a listening location along a listening axis perpendicular to a line joining the left and right main speakers. A right sub-speaker and a left sub-speaker are respectively disposed at right and left sub-speaker locations equidistantly spaced from the listening location, and further from the listening location than the main speaker. In one particular arrangement each main speaker includes a driver and a tweeter and each sub-speaker includes only a driver. The left and right channel outputs are respectively coupled to the left and right main speakers. A left channel minus right channel difference signal is coupled to the left sub-speaker and a right channel minus left channel difference signal is coupled to the right sub-speaker. In one embodiment, the main and sub-speakers for each channel are respectively incorporated in a common enclosure to fix the spacing therebetween. A technique for determining optimal spacing between the main and sub-speakers and between the various speakers and the listening location is set forth.

9 Claims, 14 Drawing Figures

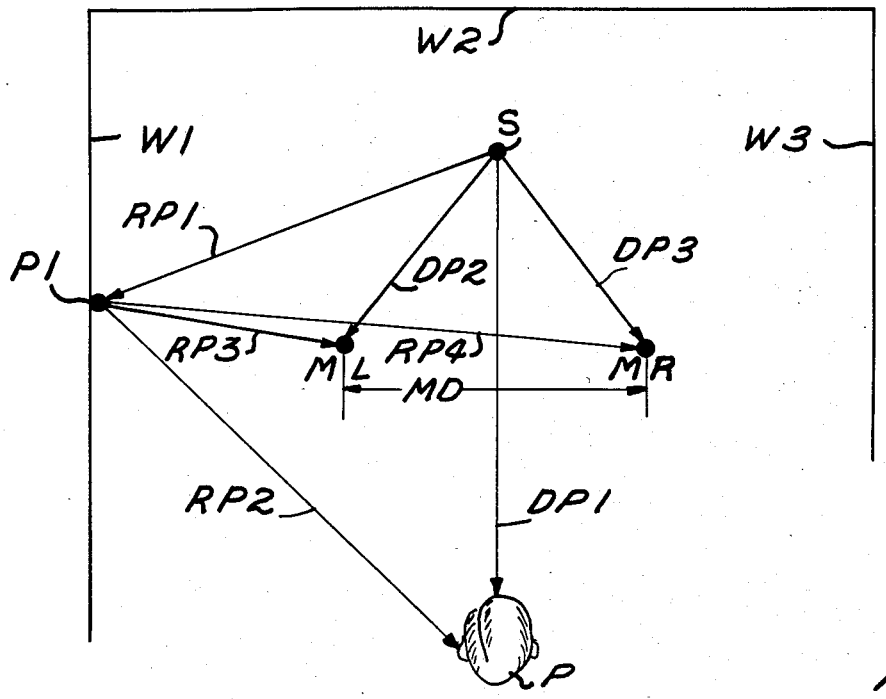
Fig. 1.
Fig. 2.
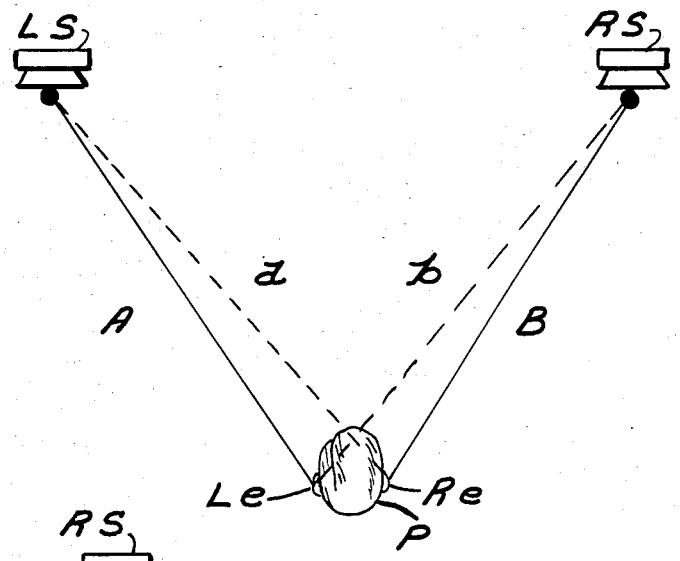
Fig. 3.
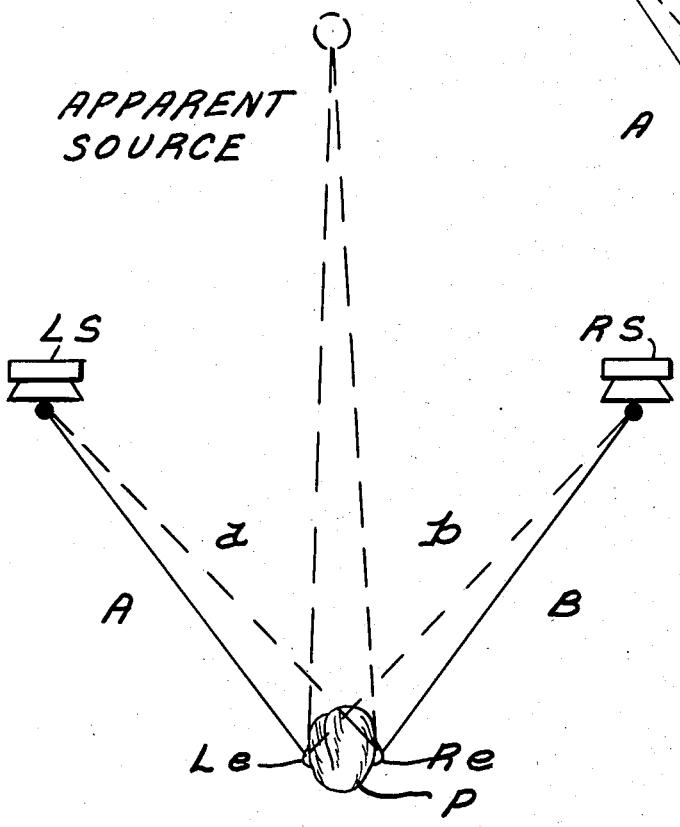

METHOD AND APPARATUS FOR REPRODUCING SOUND HAVING A REALISTIC AMBIENT FIELD AND ACOUSTIC IMAGE

CROSS-REFERENCE TO RELATED APPLICATION

This application relates to an improvement in the method and apparatus disclosed in applications Ser. No. 382,151, filed May 28, 1982 now U.S. Pat. No. 4,489,432 and Ser. No. 616,249, filed June 1, 1984, now U.S. Pat. No. 4,569,074.

BACKGROUND OF THE INVENTION

This invention pertains to a method and apparatus for reproducing sound from stereophonic source signals in which the reproduced sound has a realistic ambient field and acoustic image.

The present invention can best be understood and appreciated by setting forth a generalized discussion of the manner in which stereophonic signals originate, as well as a generalized discussion of the manner in which sound is conventionally reproduced from a stereophonic signal source.

When live music is, for example, performed the listener perceives both the sonic qualities of the instruments and the performers and also the sonic qualities of the acoustic environment in which the music is performed. Normal stereophonic recording and reproducing techniques retain much of the former, but most of the latter is lost.

The human auditory system localizes position through two mechanisms. Direction is perceived due to an interaural time delay or phase shift. Distance is perceived due to the time delay between an initial sound and a similar reflected sound. A third, poorly understood mechanism, causes the ear to perceive only the first of two similar sounds when separated by a very short delay. This is called the precedence effect. Through these mechanisms the listener perceives the direct sound reflected from the walls of the hall. Due to the direction and distance information contained in the reflected signals the listener forms a subliminal impression of the size and shape of the hall in which the performance is taking place. Referring to FIG. 1, for example there is illustrated a source S spaced from a listener P in an environment which includes a plurality of walls, W1, W2, and W3. In such an environment the listener will of course perceive sounds from the source S along a direct path DP1. Also, the listener will perceive sounds reflected from the walls of the environment, illustrated in FIG. 1 by the path RP1 to a point P1 on the wall W1 and thence along path RP2 to the listener P. In stereophonic recording, microphones ML and MR are situated in front of the source S as shown in FIG. 1. If the source S is equidistant from the microphones, then both microphones will pick up sounds from the source S along direct paths DP2 and DP3. In addition, the hall ambience information will be recorded by the left and right microphones ML and MR in addition to the direct sound from the source. This is illustrated by the reflected paths RP3 and RP4 from the point P1 on wall W1.

Turning now to FIG. 2, there is illustrated what happens when the sounds recorded by the microphones as in FIG. 1 are reproduced by loudspeakers LS and RS positioned in the same position relative to the listener P as the recording microphones. In FIG. 2 the listener P is shown as having a left ear Le and a right ear Re. If the sound recorded as in FIG. 1 was initially equidistant from the two microphones, the sound will reach each microphone at the same time. Accordingly, in reproducing the sound, a listener equidistant from the two speakers LS and RS will hear the reproduced direct sound from the left speaker in the left ear (path A) at the same time as the same sound from the right speaker is heard in the right ear (path B). The precedence effect will tend to reduce perception of interaural crosstalk paths a and b. The listener P, hearing the same sound in both ears at once will localize the sound as being directly in front of and between the speakers, as shown in FIG. 3.

Referring again for a moment to FIG. 1, consider a sound reflected from the point P1 on the wall W1 of the hall. The reflected sound from the secondary source reaches the left microphone ML first via the path RP3. This sound is delayed relative to the direct sound along path DP2, partially preserving the distance information about the reflection from P1. The sound from P1 at some time thereafter reaches the right microphone MR along path RP4 after a further delay and further reduction in loudness. In this case, the delay corresponds approximately to the distance MD between the microphones. Turning now to FIG. 4, there is illustrated what the listener P will hear with respect to both the direct and reflected sound illustrated in FIG. 1. When reproduced by the loudspeakers LS and RS the listener will first hear the direct sound from the source at the same time in both ears, corresponding to the apparent source shown in FIG. 4. The listener will then hear the delayed sound corresponding to the reflection from P1 being recorded by the left microphone and reproduced by the left speaker first in the left ear Le and then in the right ear Re. The initial delay caused by the longer path taken by the reflection in reaching the left microphone ML gives the listener an impression of the distance between the original source, P1, and himself. However, the interaural delay t, (corresponding to the time it takes sound to travel between a listener's ears) gives the impression that the reflected sound has come from a point behind and in the same direction as the left speaker, illustrated as the first apparent point P1 in FIG. 4. For reference, the location of the actual point P1 is also in FIG. 4. After a further delay, the listener will hear the reflected sound reproduced by the right speaker RS. Since the additional delay (corresponding to the distance MD in FIG. 1) is much greater than any possible interaural delay (except for the case of a very small microphone spacing) this sound will create a second apparent point P1 behind and in the same direction as the right speaker, as illustrated in FIG. 4. However, it has been observed in experiments that the listener mainly perceives the direction information of the first apparent point source P1, largely ignoring the second. Thus the listener perceives the sound as coming primarily from the direction of the left speaker or slightly inside the left speaker if the loudness of the sound apparent point source P1 is significant compared to the first. This analysis describes the effect on any other sound sources recorded by the two microphones such that the difference in arrival times at the two microphones is greater than the maximum possible interaural time delay.

Referring to FIG. 5, for some reflected sounds the path lengths to the two microphones ML and MR will be such that the differences in arrival times of the reflected sound at the two microphones will be comparable to a possible value of interaural time delay. Thus, the reflected sound from point P2 to the left microphone ML along path d' would be approximately equal to the path length c' to the right microphone MR plus the interaural time delay $\Delta t$. Thus, assume that d' equals $c'+\Delta t$. When this occurs, the arrival of the reproduced sound from the two speakers at the corresponding ears at slightly different times will have the same effect as an interaural time delay giving the listener a definite impression of the direction and distance of the reflected sound. Referring to FIG. 6, as there illustrated each possible value of interaural time delay corresponds to an angle of incidence for the perceived sound within a 180° arc. As the difference in arrival times at the mirophones approaches the maximum possible value of the interaural delay, the apparent direction of the sound would swing rapidly to the right or left. In practice this is limited by the listening angle of the loudspeakers. When the time difference of the sounds arriving at the respective ears approaches the interaural delay corresponding to the listening angle of the speakers, the interaural crosstalk signal of the opposite speaker gradually takes precedence effectively limiting the apparent sound sources to within the listening angle of the speaker.

It should be apparent at this point that all sound sources, ambient or otherwise, whose signals arrive at the respective microphones with a time difference greater than the interaural time delay corresponding to the listening angle of the reproducing speakers will appear to the listener as apparent sources behind and in the same general direction as one of the speakers as shown in FIG. 4. The delayed signal appearing in the other channel, being lower in loudness, will have only slight effect in drawing the apparent source inside the speakers. This has been confirmed by experiments which show that, in fact, the apparent sound source remains substantially within the listening angle defined by the speakers.

The existence of interaural crosstalk has long been known and discussed at some length in the literature. Additionally, there are several recent patents which have disclosed methods and techniques for eliminating interaural crosstalk, without however making a complete analysis of the consequences of so doing.

One such prior art patent is U.S. Pat. No. 4,058,675 to Kobayashi et al. This patent discloses a means for cancelling interaural crosstalk using inverted and delayed versions of the left and right stereo signals fed to a second pair of speakers arranged to produce the correct geometry. As explained in U.S. Pat. No. 4,218,585 to Carver, the Kobayashi et al device is only partially effective. Carver discloses in U.S. Pat. No. 4,218,585 an electronic device for cancelling interaural crosstalk. This device inverts one stereo signal, splits it into several components, delays each component separately by a different amount and recombines these with a modified version of the other stereo signal. Performing this operation on both stereo signals, Carver claims to effect a cancellation of interaural crosstalk and to create a "dimensionalized effect."

U.S. Pat. No. 4,199,658 to Iwahara also discloses a technique for performing the interaural crosstalk cancellation. Iwahara uses a second pair of speakers to reproduce the cancellation signal, which is composed of a frequency and phase compensated version of the inverted main signal. This cancellation signal is fed to a speaker just outside the main speaker on the opposite side from which the cancellation signal was derived. The necessary delay is accomplished acoustically by the placement of the sub-speakers and detailed consideration is given to the phase and frequency compensation required to accomplish the cancellation. Additionally, a binaural signal input is specified. It will be seen later why a binaural input is essential to the correct function of an interaural crosstalk cancellation system.

Assuming that a method or technique is successful in cancelling the interaural crosstalk, it should be examined what effect this would have on the listener's perception of the reproduced sound. Referring to FIG. 2, if the interaural crosstalk cancellation were successful, paths a and b to the opposite ears would be eliminated. This would help the localization of sources equidistant from the recording microphones (FIGS. 1 and 3). As the sources moved off-center, however, the difference in arrival times at the two microphones increases corresponding to larger values of interaural time delay and hence greater angles of incidence as illustrated in FIG. 6. Since the crosstalk paths from the speakers have been cancelled out, the speakers give no directional information about themselves. The perceived direction of the apparent sound source will depend only on the difference in arrival times of the signal at the two recording microphones and to a much lesser degree the relative loudness. FIG. 7, for example, shows an off axis source whose signal arrives at the right microphone $\Delta t$ later than at the left microphone. In this example $\Delta t$ is equal to the maximum possible interaural time delay. When reproduced, with crosstalk cancelled, the right channel signal will arrive at the right ear $\Delta t$ later than the left signal at the left ear. FIG. 8 shows the apparent source displaced far to the left of the listener, which it would appear to the listener in such a circumstance.

It should be clear that for microphones spaced far apart only a small displacement off the equidistant axis will be required to create an arrival time difference at the microphone equal to the maximum possible interaural time delay. This will result in a rather dramatic expansion of a small portion of the center of the stereo stage. For sound sources further displaced and coresponding to time delays greater than the maximum possible interaural time delay, which will include most of the ambience information, the listener will have difficulty localizing any apparent source. In effect, the listener will be forced to perceive sounds as if he had ears placed at the recording microphone spacing and may perceive apparent sound sources within his own head when the microphone spacing is large. An accurate prediction of the effects of this situation is beyond the current state of the art of psychoacoustics and beyond the scope of this discussion. It is precisely because of this potential difficulty that the U.S. Pat. No. 4,199,658 to Iwahara specifies a binaural signal input. That is to say, that the recording has been made with a microphone spacing equal to the ear spacing. However, recordings made in this manner are extremely rare. It is also possible that the problem outlined above accounts for the unspecified "dimensionalized effect" referred to by Carver in U.S. Pat. No. 4,218,585. Use of any of the above-mentioned crosstalk cancellation systems with commonly available recordings might well result in the effect described by Carver:

> "The overall effect of this is a rather startling creation of the impression that the sound is 'totally dimensionalized', in that the hearer somehow appears to be 'within the sound' or in some manner surrounded by the various sources of the sound." (U.S. Pat. No. 4,218,585, column 9, lines 35–39)."

Although this effect that Carver describes may be an interesting aural effect, it is not believed to give a realistic impression of the original performance, particularly in the reproduction of ambience information which constitutes the majority of far-off axis signals.

BRIEF DESCRIPTION OF THE DRAWINGS

FIG. 1 is a diagram of the typical environment in which stereophonic recordings are made.

FIG. 2 is a diagram illustating conventional stereophonic sound reproduction, and showing interaural crosstalk paths.

FIG. 3 is a diagram showing the apparent source as perceived by a listener for a sound source equidistant from the recording microphones when the sound is reproduced over a pair of speakers.

DESCRIPTION OF THE PREFERRED EMBODIMENTS

Figure 9:
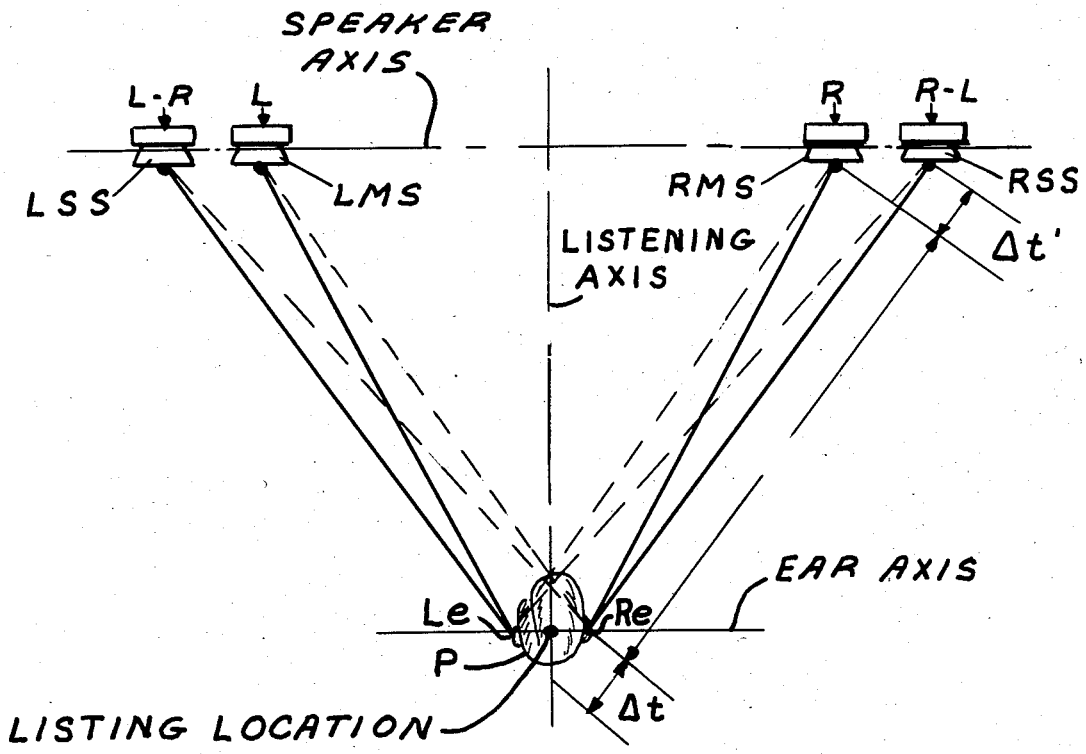
FIG. 9 is a diagram showing use of main speakers and sub-speakers in accordance with one aspect of the invention.
Figure 10:
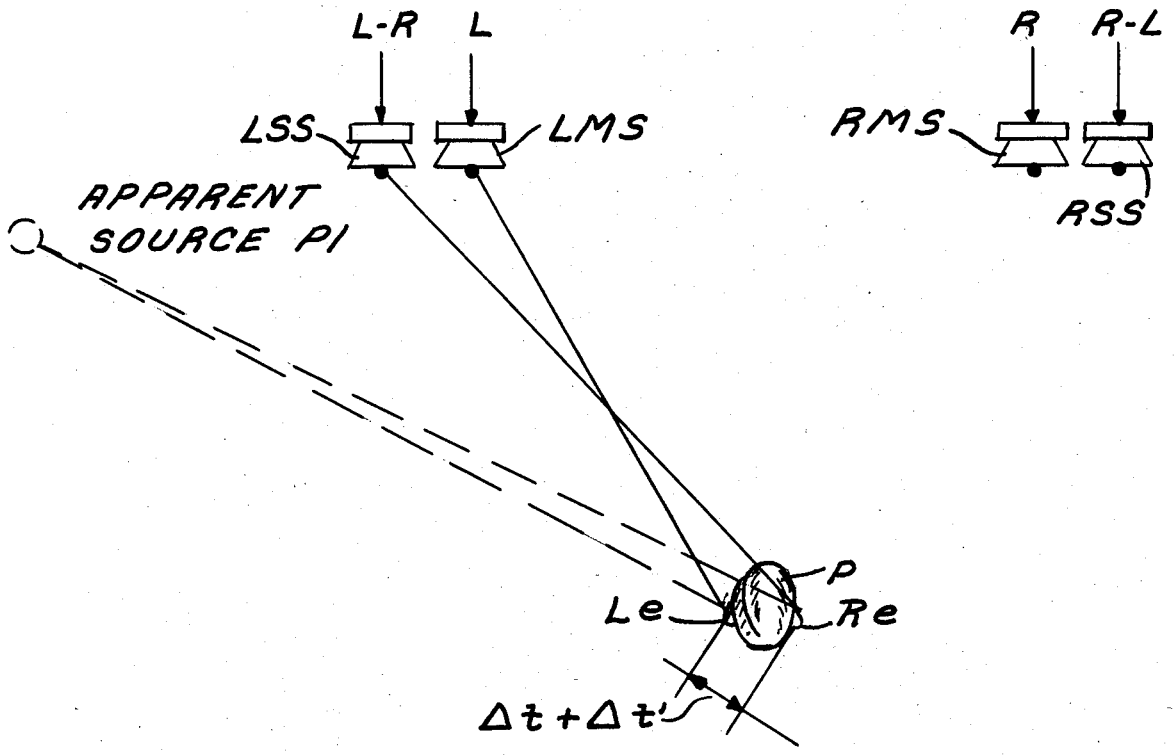
FIG. 10 is a diagram illustrating an apparent source location as produced by the arrangement of FIG. 9.
Figure 11:
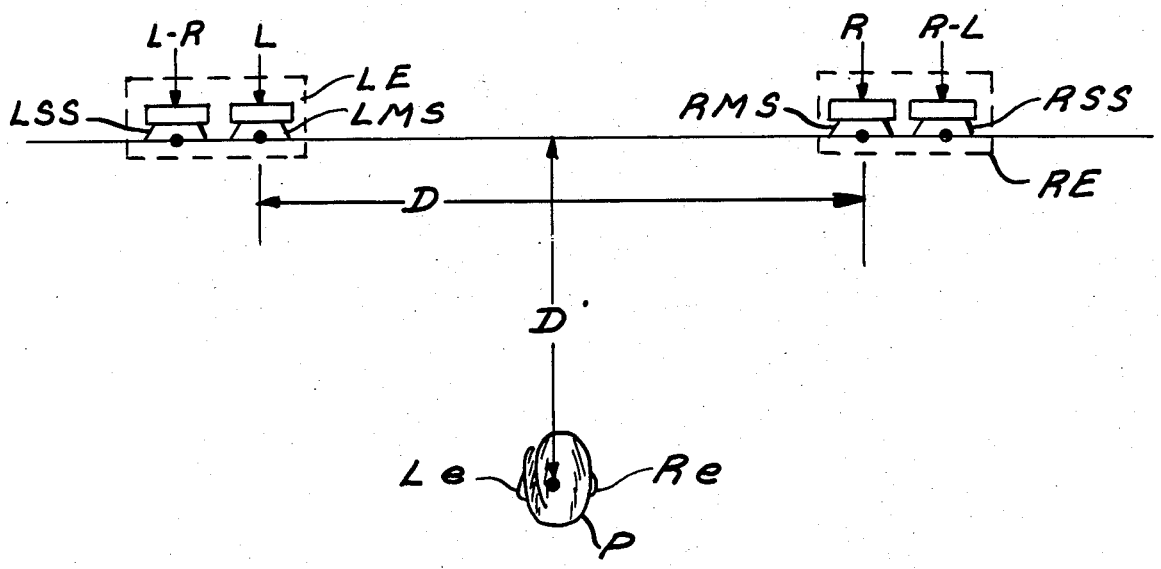
FIG. 11 illustrates an embodiment of the invention in which the sub-speakers and main speakers are commonly mounted in respective enclosures.

FIGS. 9 through 11 illustrate a method and apparatus as disclosed in U.S. Pat. No. 4,489,432. As shown in FIG. 9, a left main speaker LMS and a right main speaker RMS are disposed at left and right main speaker locations along a speaker axis and the left and right main speakers are equidistantly spaced from a listening location. The listening location is defined as the point common to a listening axis perpendicular to the speaker axis and equidistantly spaced from the main speakers, and to the ear axis at a point midway between the left ear Le and right ear Re of a person P.

A left sub-speaker LSS and a right sub-speaker RSS are also provided at left and right sub-speaker locations which, in accordance with this one embodiment, are situated on the speaker axis. The left and right sub-speakers are also equi-distantly spaced with respect to the listening location.

As shown in FIG. 9, the right and left main speakers are fed the right and left channel stereo signals, respectively. The sub-speakers, positioned outside the left main speaker and outside the right main speaker are fed the difference signals left channel minus right channel and right channel minus left channel, respectively.

Applications of the stereo difference signals (left channel minus right channel and/or right channel minus left channel) have long been known and are discussed both in the literature and in various prior art patents. For example, U.S. Pat. No. 3,697,692 to Hafler describes a method of synthesizing 4-channel sound using rear speakers fed by a difference signal. This system was later made commercially available as the Dynaco QD-1 "Quadaptor". As a further example, U.S. Pat. No. 4,308,423 to Cohen describes an electronic device for cancelling interaural crosstalk and amplifying off-axis stereo images. This is accomplished by creating a difference signal, left minus right, which is electronically delayed and mixed with the main left signal. The inverted difference signal right minus left is delayed electronically and mixed with the main right signal. Cohen describes this technique as a method of cancelling interaural crosstalk without "muddying" the central region and without reducing bass output. Cohen does not, however, present any detailed analysis of the effects of this system on the reproduction of recorded sound.

The arrangement as shown in FIG. 9 accomplishes many of the same ends as the Cohen U.S. Pat. No. 4,308,423 through purely acoustic means, and with some advantages over Cohen. That this arrangement also produces a realistic treatment of recorded material will be seen from the following analysis.

In order to facilitate the analysis, consider the left and right signals as functions of time. Specifically, distances will be expressed as sound distances, which correspond to the time it takes sound to travel the distance in question. As shown in FIG. 9, the time required for sound from the main right speaker RMS to reach the right ear Re is t. The signal at the right ear from this speaker will be designated R(t). The quantity $\Delta t$ is the interaural time delay corresponding to the listening angle of the speakers relative to the listener as shown in FIG. 9, and $\Delta t'$ is the delay of the difference signal, e.g. R-L, relative to the main signal, e.g. R, as determined by the relative placement and orientation of the speakers and listener as shown in FIG. 9. Using this notation, the signals arriving at the left and right ears would be:

Left Ear:

$$L(t)+L(t+\Delta t')-R(t+\Delta t')+R(t+\Delta t)+R(t+\Delta t+\Delta t')-L(t+\Delta t+\Delta t') \quad (1)$$

Right Ear:

$$R(t)+R(t+\Delta t')-L(t+\Delta t')+L(t+\Delta t)+L(t+\Delta t+\Delta t')-R(t+\Delta t+\Delta t') \quad (2)$$

First, consider a source whose sound arrives at both microphones at the same time during recording. Since the left and right channel signals are the same, there will be no difference signal. This is analogous to the situation shown and described with reference to FIG. 3 where the listener, hearing the same signal in both ears at the same time, localizes an apparent sound source directly between the speakers.

As a second case consider a signal appearing only in the left channel. The signals at each ear will reduce to the following:

Left Ear:

$$L(t)+L(t+\Delta t')-L(t+\Delta t+\Delta t') \quad (3)$$

Right Ear:

$$-L(t+\Delta t')+L(t+\Delta t)+L(t+\Delta t+\Delta t') \quad (4)$$

Figure 4:
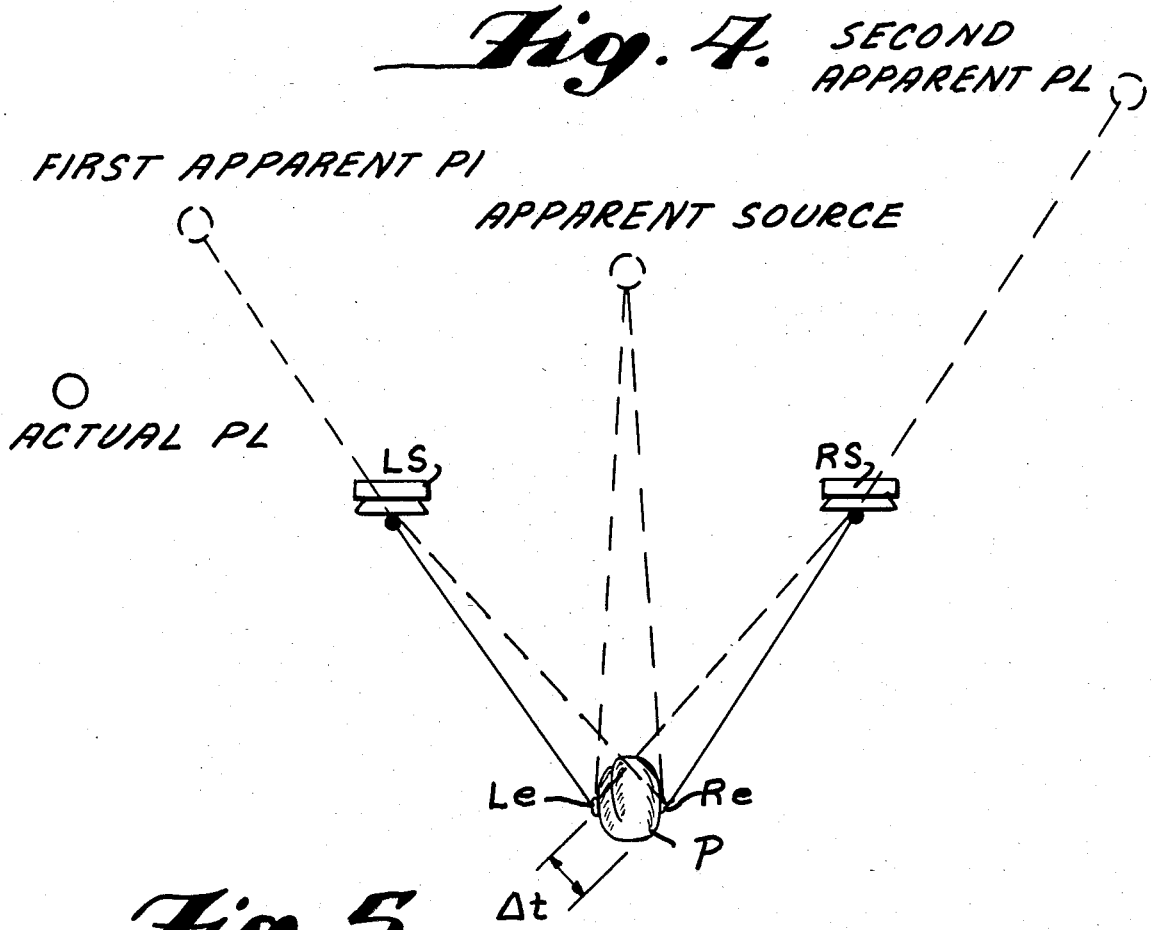
FIG. 4 is a diagram illustrating the location of apparent sources to a listener when a stereophonic recording is reproduced, taking into account reflection of sound from the walls of the hall in which the recording was made.
Figure 5:
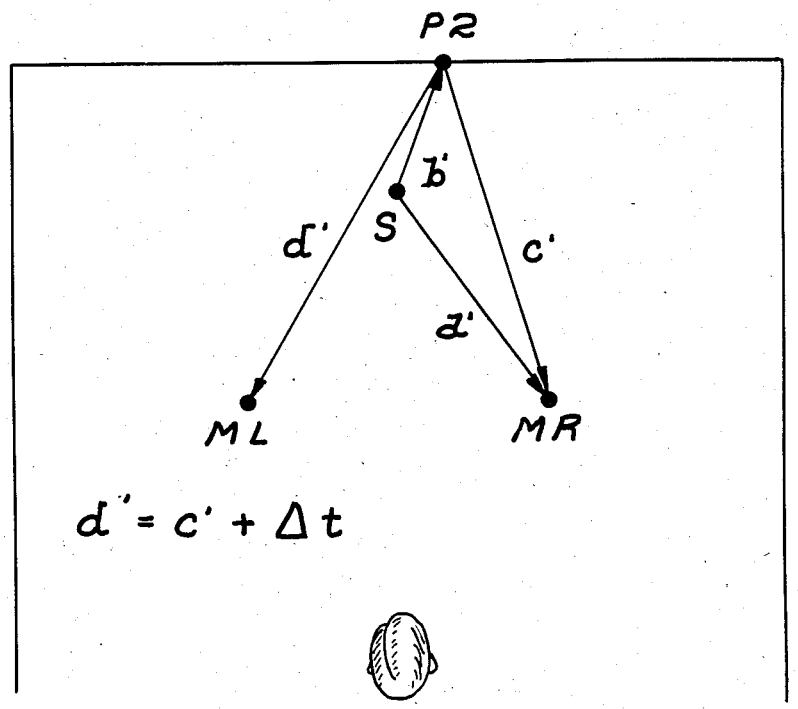
FIG. 5 is a diagram illustrating a situation where path lengths to two recording microphones for reflected sounds is such that the difference in arrival times of the reflected sound of the two microphones is comparable to a possible value of interaural time delay.
Figure 6:
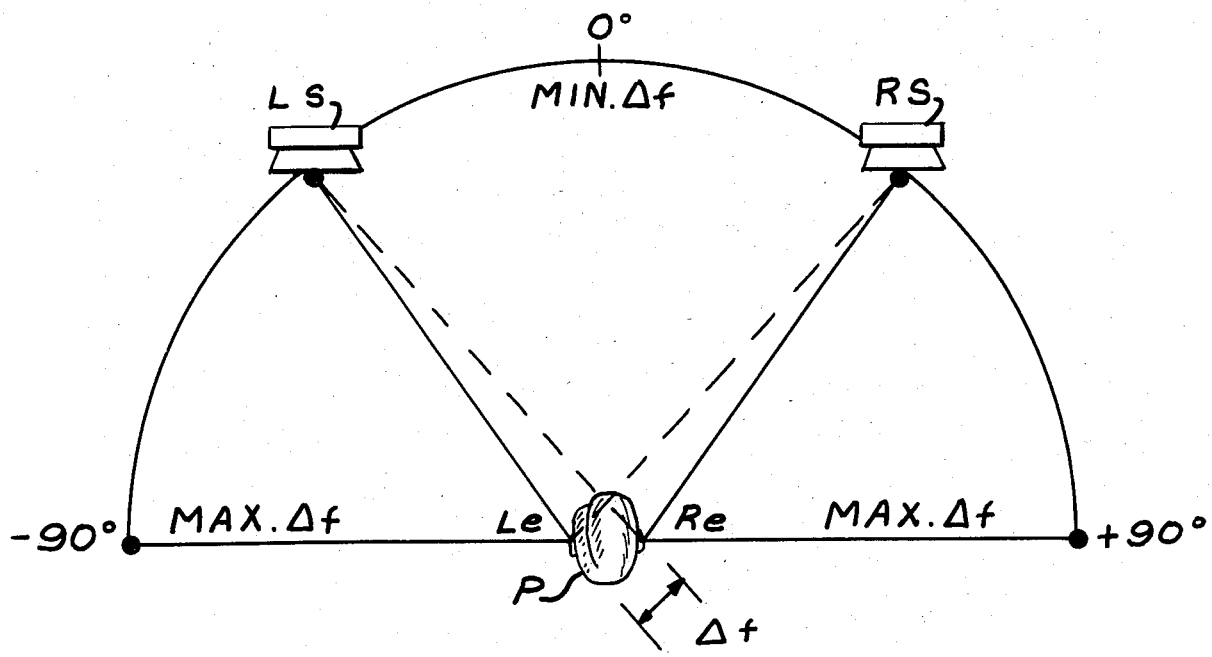
FIG. 6 is a diagram showing how each possible value of interaural time delay corresponds to an angle of incidence for perceived sounds within a 180° arc.
Figure 7:
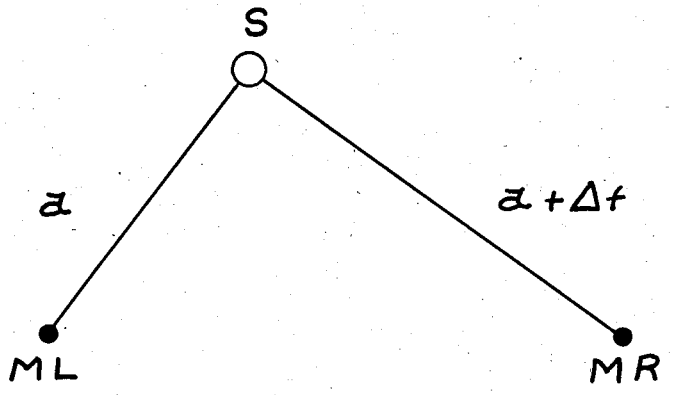
FIG. 7 is a diagram illustrating an off-axis source whose signal arrives at the right microphone $\Delta t$ later than at the left microphone, where $\Delta t$ is equal to the maximum possible interaural time delay.
Figure 7:
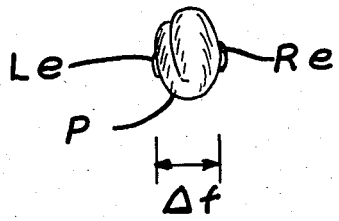
Figure 8:
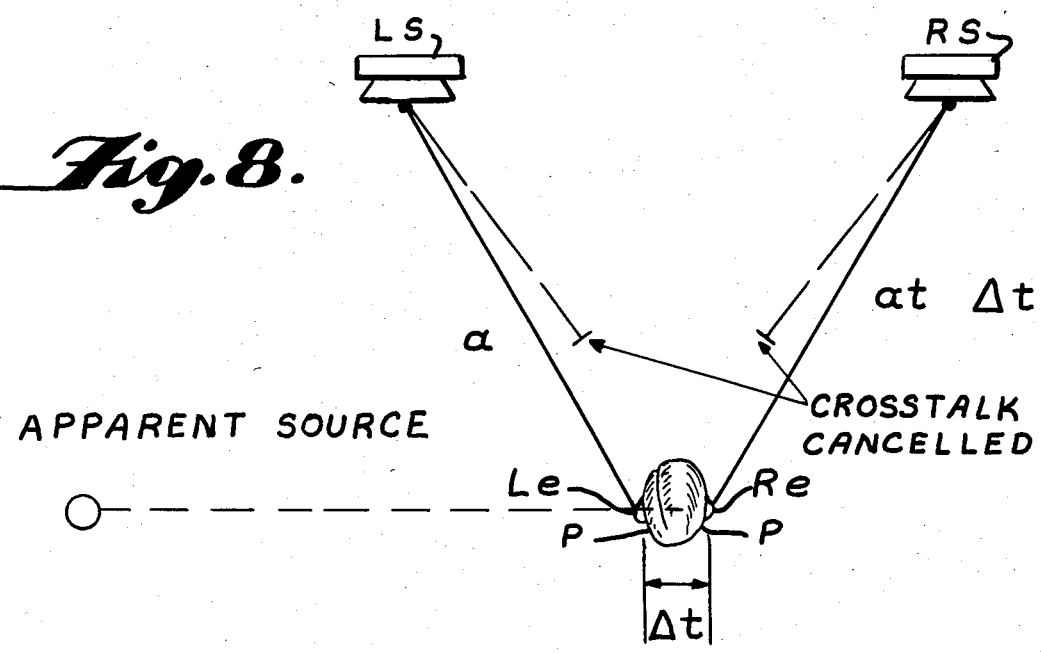
FIG. 8 illustrates the apparent source that would appear to a listener for the situation shown in FIG. 7 when the recording were reproduced on a pair of speakers.

If $\Delta t$ is comparable to $\Delta t'$ the right ear terms will largely cancel leaving only $L(t+\Delta t+\Delta t')$ corresponding to the left channel main signal portion of the difference signal emanating from the left sub-speaker and delayed by both the inter-speaker time delay $\Delta t'$ and the interaural time delay $\Delta t$. Due to the precedence effect, the left ear will mainly perceive only the first signal to arrive, L(t). FIG. 10 illustrates the apparent source that a listener would perceive in such a situation. Referring to FIG. 10, hearing the main left signal in the left ear and the same signal delayed by $t+\Delta t'$ in the right ear, the listener will perceive an apparent sound source with a listening angle outside the speakers corresponding to an interaural delay of $t+\Delta t'$ as illustrated in FIG. 10. Referring to FIG. 4, ambience information reflected from point P1 on wall W1 would appear first only in the left channel and sometime later (roughly corresponding to the microphones spacing for this specific case) would appear in the right channel. Referring to FIG. 10, the listener would perceive an apparent source as shown in FIG. 10 showing a good correspondence with the correct ambience information. A second apparent source on the right would seem to be indicated at the time that the signal arrives at the right microphone, further away and at a lesser loudness. However, it has been observed in experiments that the listener perceives only the first apparent source. This is probably due to the ability of the auditory system to assign direction to the first and loudest of similar sounds, as discussed previously.

As the recorded source moves more towards the center of the recording microphones, the difference in arrival times at the microphones will become less. This means that the time that a signal will exist only in one or the other channel will become shorter, and the question of the relative loudness of the signal in each channel becomes important in assigning a direction to the apparent source. Consider a case where the same signal appears in both left and right channels but with the left channel twice as loud as the right channel. The respective ears would receive the following signals, after combining like terms:

Left Ear:

$$L(t)+L/2(t+\Delta t')+L/2(t+\Delta t)-L/2(t+\Delta t+\Delta t') \quad (5)$$

Right Ear:

$$L/2(t)+L(t+\Delta t)-L/2(t+\Delta t')+L/2(t+\Delta t+\Delta t') \quad (6)$$

If $\Delta t$ equals $\Delta t'$ these expressions will further reduce to:

Left Ear:

$$L(t)+L(t+\Delta t)-L/2(t+\Delta t+\Delta t') \quad (7)$$

Right Ear:

$$L/2(t)+L/2(t+\Delta t)-L/2(t+\Delta t+\Delta t') \quad (8)$$

In this case the right ear would hear the same signal at the same time as the left ear, but at half the strength. The listener will perceive the apparent sound source as slightly shifted to the left of center between the speakers.

However, if $\Delta t'$ is made slightly greater than $\Delta t$ an important result is obtained. Referring back to the original terms with the terms being rearranged in order of arrival time at the ears, the following is obtained:

Left Ear:

$$L(t)+L/2(t+\Delta t)+L/2(t+\Delta t')-L/2(t+\Delta t+\Delta t') \quad (9)$$

Right Ear:

$$L/2(t)+L(t+\Delta t)-L/2(t+\Delta t')+L/2(t+\Delta t+\Delta t') \quad (10)$$

The left ear will perceive only the main signal, L(t), since the other signals are weaker and later. The right ear however, has a half strength signal which arrives first followed by a full strength signal delayed by $\Delta t$. The precedence effect does not fully mask the late arrival of the stronger signal so that the listener perceives, at least slightly, a direction cue placing the apparent sound source at a listening angle corresponding to an approximate interaural delay slightly less than $\Delta t$. This will place the apparent sound source nearly out to the left speaker. As the right channel signal is increased further, relative to the left channel signal, the difference signal is reduced gradually to zero as the channels become equal. The precedence effect gives increasing importance to the now louder first signal arrival at the right ear and the listener perceives a smooth shaft of acoustic image towards the center between the speakers. Conversely, if the right signal is reduced further from the L/2 relative loudness, the exact opposite will occur. The difference signals will become louder and the listener will perceive a smooth shift of acoustic image outward to the perimeter of the 180° stereo field.

In order for a smooth image transition to occur, the inter-speaker delay $\Delta t'$ between the respective main and sub-speakers along the listening angle between the speakers and the listening location must be greater than the interaural delay $\Delta t$ as shown in FIG. 9 along the listening angle of the listening location with respect to the speaker locations by enough to insure the desired function of the precedence effect as outlined above. In experiments, it has been found that if $\Delta t$ equals $\Delta t'$ the effect is not unpleasant, it is just that the optimum ambience information is not present in the reproduced sound field. Although in accordance with a preferred embodiment $\Delta t'$ is greater than $\Delta t$, in order to obtain the best image quality outside the listening angle of the speakers, $\Delta t'$ should be close enough to $\Delta t$ such that a substantial cancellation of interaural crosstalk occurs. In practice it has been found that values of $\Delta t'$ about 1.2 times greater than $\Delta t$ provide a suitable compromise and provide a realistic ambient field and acoustic image.

As shown in FIG. 9, in accordance with one specific embodiment the left and right main and sub-speakers are located at respective main and sub-speaker locations arranged on a speaker axis which is parallel to an ear axis of a listener in a normal listening position along a listening axis equidistant from the two sets of speakers. It should be understood, however, that any arrangement of main and sub-speakers giving the proper inter-speaker delay $\Delta t'$ will suffice. The arrangement of FIG. 9 where both the main and sub-speakers are located on an axis parallel to the ear axis of a listener does, however, have advantages in allowing greater flexibility in listener position. That is, exact listener positioning is more critical when the sub-speakers are not on the same axis as the main speakers, or if the sub-speakers are not parallel to the main speakers.

It should be understood that the drawing in FIG. 9 is diagrammatic in nature and not intended to be perfectly in scale. The distance Re to RMS is equal to t, and the distance from Re to RSS is shown as $t+\Delta t'$. Thus, for ease of explanation and illustration, the distance t has been assigned to two non-parallel lines originating at Re and terminating in the plane defined by the dimension line extending from RMS. As known by those familiar with this art, the placement of loudspeakers relative to the listener is normally of a distance vastly greater than the magnitude of any possible value of $\Delta t$, or $\Delta t'$. In this case, the difference between the distances repesented by the line Re to RMS, and the line Re to the intersection of the RMS dimension line is negligibly small and has no effect on the operation. The distance between RMS and RSS is specified only by the direct requirement that the arrangement give the proper inter-speaker delay $\Delta t'$. The required distance relationships are easily accommodated with both RMS and RSS lying on the speaker axis. An arc of radius $t+\Delta t'$ centered at Re will intersect the speaker axis at the required location of RSS. However, at any noraml distance from listener to speakers the length of arc of radius t centered at Re and bounded by the lines Re-RMS and Re-RSS would be very accurately approximated by the chord of the arc. Accordingly, this method was chosen so as to make a more straightforward presentation in the drawings.

It is possible that some modifications of the frequency or phase response of the main or sub-speakers may be desirable. One example might be the attenuation of bass response in the sub-speakers. This would be desirable since very little difference information exists between the channels at low frequencies other than turntable rumble or other spurious signals. In addition, it is desirable that the main and sub-speakers be very similar, if not identical, in construction. This will assure that differences in acoustic position of dissimilar drive units or differences in phase shift of dissimilar cross-over networks will not occur and hence not degrade the performance of the system.

Additionally, it should be understood that in order to obtain the best performance from the system that there are some limitations on the placement of the speakers relative to the listener. If it is desired to obtain the best performance, the sum of $\Delta t+\Delta t'$ (FIG. 9) should never exceed the maximum possible interaural time delay $\Delta t_{max}$ corresponding to a distance along the ear axis. For an average person, the spacing between the ears is on the order of 6.5–6.75 inches, so that the $\Delta t_{max}$ corresponds to the time it takes sound to travel such a distance.

Referring to FIG. 11, the condition that the sum of $\Delta t$ and $\Delta t'$ should not exceed the maximum possible interaural time delay $\Delta t_{max}$ can be met in practice if the distance between the left and right main speakers D along the speaker axis is always less than the perpendicular distance from the listening location along the listening axis D' with respect to the speaker axis. In practice, it has been found that good results are obtained if the spacing D between the main speakers is on the order of 0.7 to 0.9 times as large as the distance D'. In experiments, it has been observed that as D gets very close to D', the realistic ambient field and enhanced acoustic image that is otherwise obtained begins to disappear.

In accordance with one preferred embodiment of the invention, and as illustrated in FIG. 11, the left main speaker and the left sub-speaker may be commonly mounted in a single enclosure LE, and the right main speaker and right sub-speaker are commonly mounted in a common enclosure RE. This has the advantages of fixing the inter-speaker delay $\Delta t'$, and offers the advantage that only two speaker enclosures are required.

In accordance with a specific embodiment, a spacing between the main and sub-speakers of eight inches, with the main and sub-speakers being identical two-way loudspeakers each having a six inch woofer and a one inch tweeter, was found to work well. With a main to sub-speaker spacing of eight inches, and assuming an ear spacing between the left and right ears of approximately 6.5 inches, this yields a value of $\Delta t'$ approximately 1.2 times greater than $\Delta t$, as discussed herein before as a suitable compromise.

In accordance with an improvement to the basic invention disclosed in U.S. Pat. No. 4,489,432, additional research has revealed that the interaural time delay is dependent to a certain extent on the frequency of the sound passing across the listener's head. A sound arriving from a location directly to one side of the listener must traverse the distance between the listener's ears, roughly 6.5–6.75 inches, to reach the opposite ear. Assuming a distance of 6.75 inches, and using 1090 feet per second as the speed of sound in air, this distance corresponds to a time delay of 0.516 milliseconds. However, recent research has revealed that the actual time delay for sounds of frequency less than approximately 1 KHz is closer to 0.8 milliseconds, apparently due to the effect of the size and shape of the head on these frequencies. Above 1 KHz the delay rapidly reverts to the expected value of 0.5 milliseconds.

Figure 12:
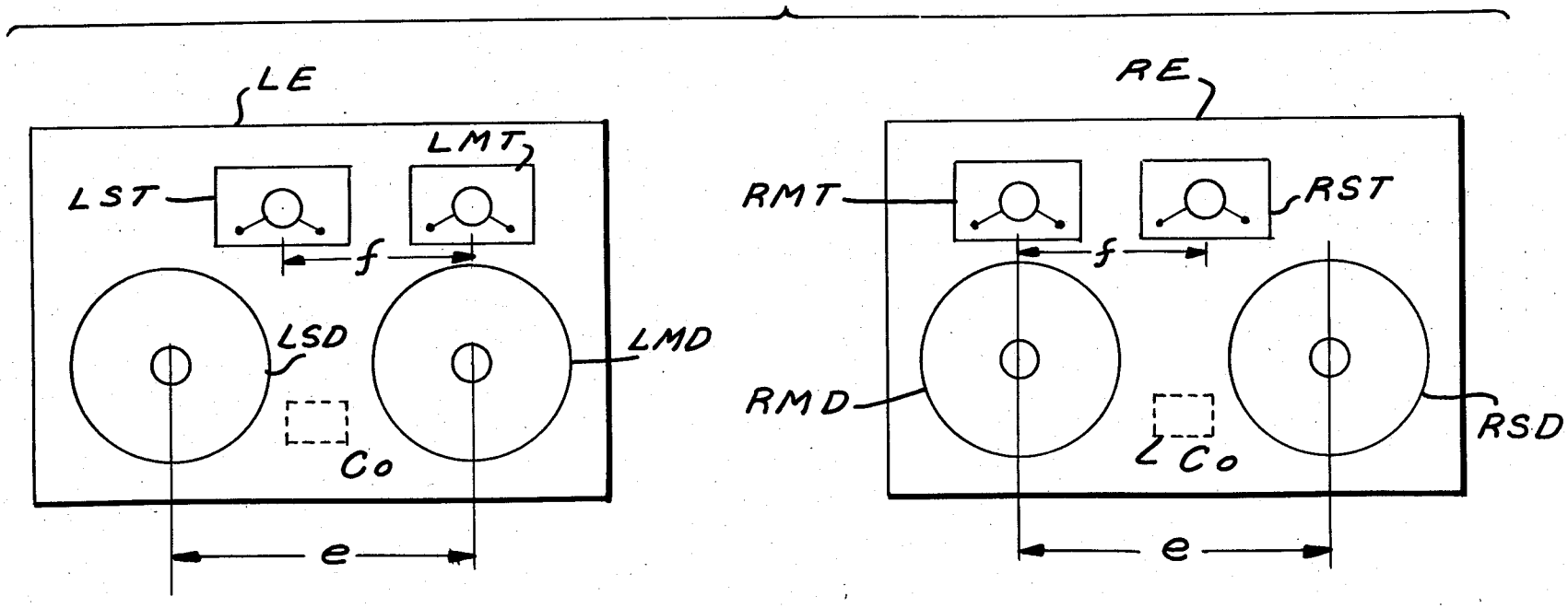
FIG. 12 illustrates an embodiment of an improvement in which sub-speakers and main speakers are mounted in respective enclosures, and a sub-speaker tweeter is more closely spaced to the main speaker tweeter than the sub-speaker driver is to the main speaker driver.

Referring now to FIG. 12, there is shown an improvement which is disclosed and claimed in copending application Ser. No. 616,249 filed June 1, 1984, which takes into account this different interaural delay for sounds of frequency less than 1 KHz. The left and right main speakers and sub-speakers are respectively commonly mounted in a left enclosure LE and a right enclosure RE. Each of the main speakers and sub-speakers comprise a driver speaker and a tweeter speaker. Thus, the left main speaker comprises a left main driver LMD and a left main tweeter LMT, and the left sub-speaker comprises a left sub-driver LSD and a left sub-tweeter LST. Similarly, the right main speaker comprises a right main driver RMD and right main tweeter RMT, and the right sub-speaker comprises a right sub-driver RSD and a right sub-tweeter RST. Each of the right and left hand enclosures is also provided with cross-over networks CO for transition between driver and tweeter speakers, as known in the art. In accordance with the invention, the sub-speaker drivers are spaced a distance e from the main speaker locations which is approximately 50% greater than the spacing f for the sub-speaker tweeters from the main speaker locations. The cross-over networks CO are configured to effect transition between drivers and tweeters at a sound frequency of approximately 1 KHz. Thus, the inter-speaker delay between the respective main speakers and sub-speakers is approximately 50% greater for frequencies below 1 KHz than for higher frequencies. This spacing accords with experimental evidence as to the frequency dependent nature of the interaural time delay.

In accordance with a particular best mode embodiment of the improved invention as illustrated in FIG. 12, the driver is 6.5 inches in diameter, the distance f is approximately 7 inches, and the distance e is approximately 10.5 inches. This arrangement has been found to produce a realistic acoustic image.

The difference signals left channel minus right channel and right channel minus left channel which have been referred to throughout this description are easily obtained in practice by connecting the sub-speakers across the left plus and right plus terminals of a stereophonic amplifier's outputs. Connecting left plus to the plus speaker terminal of the left sub-speaker and right plus to the sub-speaker common or normal ground terminal will give a signal corresponding to the left channel minus right channel. Reversing this connection will give a signal to the right sub-speaker corresponding to the right channel minus the left channel.

In accordance with the present invention, which is an improvement to the invention disclosed in copending application Ser. No. 616,249 filed June 1, 1984, further research has revealed that the mechanism for directional hearing operates differently at low and mid frequencies than it does at high frequencies. Specifically, at low and mid frequencies the direction of a sound is primarily determined by the difference in arrival times of the sound at the two ears, known as interaural time difference. However, at high frequencies, the primary means for determining the direction of a sound is the difference in intensity of the sound at the two ears. The transition occurs around 1000 Hz, apparently being related to the fact that the distance between an average listener's ears corresponds to approximately 180 degrees of phase-shift at 1000 Hz but corresponds to phase-shift of greater than 180 degrees for higher frequencies having shorter wavelengths. Phase-shift of greater than 180 degrees creates an ambiguity as to which signal is leading and which is lagging. It is conjectured that the listener, in an effort to resolve the ambiguity suppresses the directional cues relating to arrival time and relies primarily on interaural intensity differences at the higher frequencies. Due to the short wavelength of high frequency sounds the exact position of the listener's ears becomes critical if the acoustic cancellation of interaural crosstalk is to be properly accomplished. For a left channel only signal, movement of the listener's right ear by $\frac{1}{4}$ of a wavelength closer to the left main speaker and $\frac{1}{4}$ wavelength further from the sub-speaker whose signal is intended to cancel the left channel signal reaching the right ear will cause the two signals to add constructively rather than cancel. This would cause the listener to perceive the sound as louder in the right ear than in the left despite the earlier arrival of the sound at the left ear. Due to the reliance on interaural intensity differences for the localization of sound at high frequencies the occurrence of this situation at a high frequency would cause the listener to incorrectly perceive the direction of the sound as being to the right rather than to the left. For example, if the signal in question was at a frequency of 10 kHz having a wavelength of 1.3 inches, movement of the listener's head by only 0.3 inches would cause incorrect localization of the sound as described above. However, this situation could not occur below 1 kHz due to the reliance on interaural time differences for sound localization at those frequencies. An additional problem is that the arrival of one group of frequency components at the listener's ears earlier than the other group will cause the listener to determine the direction of the sound primarily based on the information contained in the first arriving sounds only. For example, if the high frequencies are the first to arrive then interaural intensity differences will dominate the sound localization process. Said sound localization on this basis is known to be less precise than that based on interaural time differences the operation of the invention would be somewhat impaired.

Figure 13:
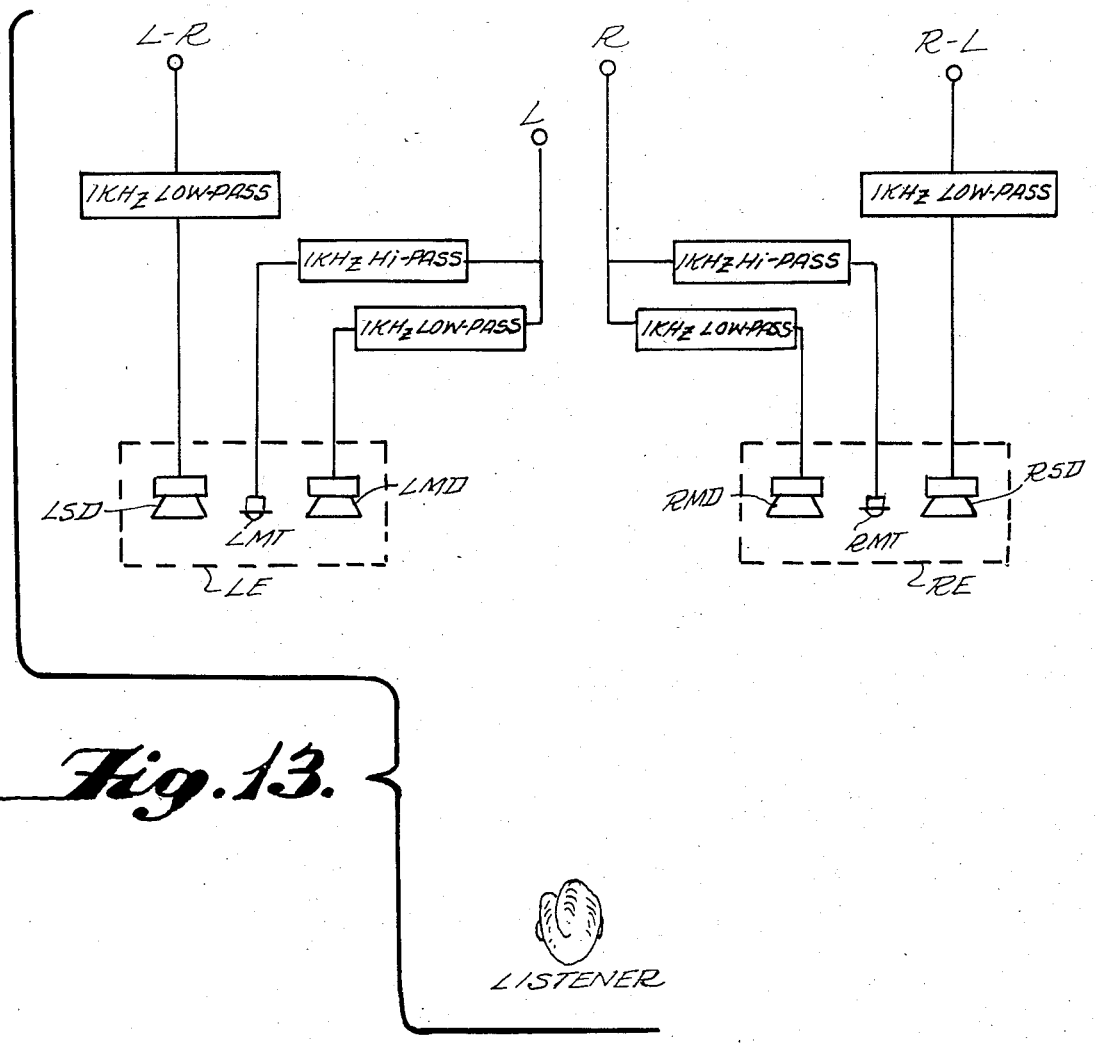
FIG. 13 illustrates an improved embodiment in the sub-speakers consist of only a driver with the main speakers having a driver and tweeter.

The present invention proposes to use the facts described above to improve the performance of the system previously disclosed for obtaining a stable expanded acoustic image. In accordance with the present invention, and as illustrated in FIG. 13, the main speaker is comprised of a driver and tweeter while the sub-speaker is comprised of only a driver. Thus in FIG. 13 the left enclosure LE includes a left main driver LMD, a left main tweeter LMT, and a left sub-speaker driver LSD. Similarly, the right enclosure RE includes a right main driver RMD, a right main tweeter RMT, and a right sub-speaker driver RSD. The crossover system for the main speaker effects a transition between the driver and tweeter at approximately 1 kHz. This is illustrated in FIG. 13 by the 1 kHz low pass filter coupling the left channel signal to the left main driver LDM, and the 1 kHz high pass filter coupling the left channel signal L to the left main driver LMD. Similarly, a 1 kHz low pass filter couples the right channel signal R to the right main driver RMD, and a 1 kHz high pass filter couples the right channel signal R to the right main tweeter RMT.

In accordance with the present invention, the sub-speaker drivers incorporate low pass filters having characteristics similar to the low pass portion of the main speaker crossover such that the sub-speakers predominately receive frequencies of 1 kHz and lower. This is illustrated in FIG. 13 by the 1 kHz low pass filter coupling the L-R signal to the left sub-speaker driver LSD and the 1 kHz low pass filter coupling the R-L signal to the right sub-speakers driver RSD. Of course, the cross-over networks and low pass filters for the sub-speakers illustrated in FIG. 13 can conveniently be incorporated with the left and right enclosures LE and RE. The right and left channel stereo signals are fed to the right and left main speakers. A right-minus-left signal is fed to the right sub-speaker and a left-minus-right signal is fed to the left sub-speaker.

Figure 14:
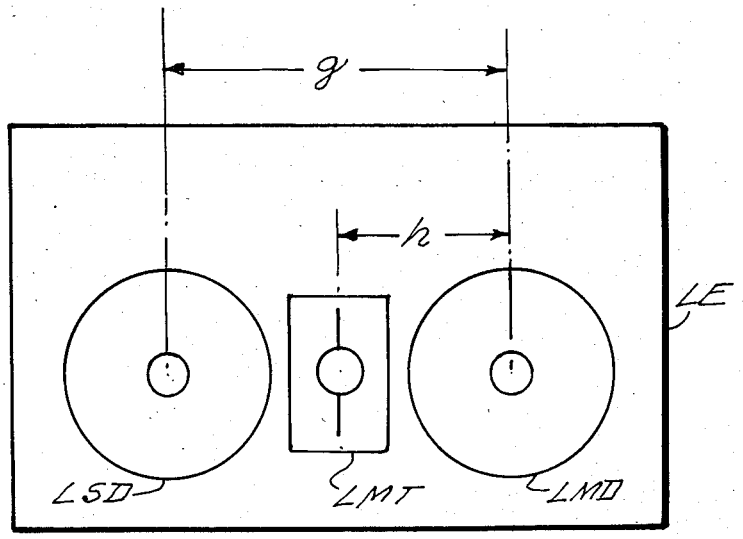
FIG. 14 illustrates a physical layout for the left main speaker and sub-speaker of FIG. 13.

Turning now to FIG. 14, there is illustrated the physical layout for a left speaker enclosure LE mounting a left main speaker and left sub-speaker in accordance with the invention. The right speaker enclosure will be a mirror image of the left speaker enclosure. In connection with the arrangement of FIG. 14, it is well known to those versed in the art that the low pass network associated with most mid or low frequency drivers causes the sound from that driver to be slightly delayed relative to the higher frequencies being produced by a tweeter and its associated high pass network. Placement of the main speaker tweeter physically further from the listener than the driver helps to preserve the phase relationships between the low and high frequencies and prevents the premature arrival of the high frequencies at the listener's ears and the consequent diminution of the system's acoustic image. Experiments have shown that a delay corresponding to a sound distance of between 1 and 4 inches is required depending on the exact nature of the crossover between the driver and tweeter. In accordance with the invention, the left main speaker tweeter LMT is spaced from the left main speaker driver LMD by a distance h, on the order of 4 to 7.5 inches so that the tweeter is further from a listener than the driver. The left sub-speaker driver LSD is spaced from the left main driver LMD by a distance g, determined in accordance with the principles of this invention as discussed above. In accordance with a particular embodiment of the present invention, as shown in FIG. 14, the drivers used for each of the main and sub-speakers are 6.5 inches in diameter, the sub-speaker driver being placed a distance of 10.5 inches from the main speaker driver. Distances of within the range of 7 to 12 inches would be appropriate. The main speaker tweeter is positioned directly between the main and sub-speaker drivers.

The present improvement offers a number of advantages over the previously disclosed method of application Ser. No. 616,249. The use of frequencies exclusively below 1 kHz to perform the cancellation of interaural crosstalk and to stabilize the acoustic image allows the directional hearing mechanism to operate unambiguously in its preferred manner in the high and low frequency ranges. The elimination of high frequency information from the sub-speakers reduces the possibility of ambiguous directional cues reaching the listeners ears, enlarges the optimum listening area and hence improves the quality and stability of the perceived stereo image. In addition, the placement of the main speaker tweeter such that the high frequency portion of the signal arrives in phase with the low frequency portion prevents the high frequency portion from dominating the sound localization process and reducing the perceived size and precision of the acoustic image. Also, by helping to preserve the relative phase relationships of the various frequency components more detailed reproduction of sound is achieved. A final advantage is that of cost. The elimination of one tweeter and the associated portion of the crossover from the original system represents a significant savings and allows the unique performance advantages of the system to be offered at a more competitive price.

Although the present invention has been described with reference to certain preferred embodiments, it is not intended to limit the invention to any specific details of those preferred embodiments. That is, it should be clear that various modifications and changes can be made to those preferred embodiments without departing from the true spirit and scope of the invention, which is intended to be set forth in the appended claims.

What is claimed is:

1. In a stereophonic sound reproduction system having a left channel output and a right channel output, apparatus for reproducing sound having a realistic ambient field and acoustic image comprising:

a right main speaker and a left main speaker disposed respectively at right and left main speaker locations equidistantly spaced from a listening location, the listening location being a place in space for accommodating a listener's head facing the main speakers and having a right ear location and a left ear location along an ear axis, with the right and left ear locations separated along the ear axis by a maximum interaural sound distance of $\Delta t_{max'}$ and the listening location being defined as the point on the ear axis equidistant to the right and left ears;

a right sub-speaker and a left sub-speaker disposed respectively at right and left sub-speaker locations equidistantly spaced from the listening location;

the right main speaker being separated from the right ear location by a sound distance t and being separated from the left ear by a sound distance $t+\Delta t$ where $\Delta t$ is the interaural sound distance spacing with respect to the right main speaker between the right ear location and the left ear location;

the right sub-speaker being separated from the right ear location by a sound distance $t+\Delta t'$ where $\Delta t'$ is the sound distance spacing with respect to the right ear location between the right main speaker location and right sub-speaker location;

the left main speaker being separated from the left ear location by a sound distance t and being separated from the right ear location by a sound distance $t+\Delta t$ where $\Delta t$ is the interaural sound distance with respect to the left main speaker between the left and right ear locations;

the left sub-speaker being separated from the left ear location by a sound distance $t+\Delta t'$ where $\Delta t'$ is the sound distance spacing with respect to the left ear location between the left main speaker location and left sub-speaker location;

each of said left and right main speakers comprising a driver and a tweeter, and wherein each of said main speaker tweeters are positioned physically further from the listening location than the main speaker drivers, each of said left and right sub-speakers consisting of only a driver which is positioned further from the listening location than the main speaker tweeter, cross-over networks for providing transition between the main speaker drivers and tweeters;

means coupling the right and left channel outputs, respectively, to said right and left main speakers;

means connected to the right and left channel outputs for developing a left channel minus right channel signal and a right channel minus left channel signal;

means coupling said left channel minus right channel signal to said left sub-speaker and said right channel minus left channel signal to said right sub-speaker;

means limiting the acoustic output of said subspeakers to frequencies below approximately 1 kHz;

whereby sound reproduced by said apparatus as perceived by a listener whose head is located generally at the listening location has a realistic acoustic field and enhanced acoustic image.

2. In a stereophonic sound reproduction system having a left channel output and a right channel output, apparatus for reproducing sound having a realistic ambient field and acoustic image comprising:

right and left main speakers each comprising a driver and tweeter, said right and left main speaker drivers disposed respectively at right and left main speaker locations equidistantly spaced from a listening location, said right and left main speaker tweeters disposed a first predetermined distance from their respective associated drivers and further from the listening location than said main drivers;

right and left sub-speakers each consisting of only a driver spaced respectively from said right and left main speakers so as to be further from the listening location than the main speakers, said sub-speaker drivers being spaced a second predetermined distance respectively from the right and left main speaker drivers, said second predetermined distance being greater than said first predetermined distance;

coupling means including crossover networks for respectively coupling the right and left channel outputs to said right and left main speakers and for effecting a transition between the main speaker drivers and tweeters, means for coupling the left channel output minus the right channel output to said left sub-speaker and the right channel output minus the left channel output to said right sub-speaker;

means limiting the acoustic output of said subspeakers to frequencies below approximately 1 kHz.

3. Apparatus in accordance with claim 2 including a left enclosure commonly mounting said left main speaker and left sub-speaker, and a right enclosure commonly mounting said right main speaker and right sub-speaker.

4. Apparatus in accordance with claim 3 wherein said first predetermined distance is approximately 4 to 7.5 inches.

5. Apparatus in accordance with claim 4 wherein said second predetermined distance is approximately 7 to 12 inches.

6. A method for reproducing sound from a stereophonic source having a left channel output and a right channel output in which the reproduced sound has a realistic ambient field and acoustic image comprising the steps of:

disposing a right main speaker and left main speaker at right and left main speaker locations equidistantly spaced from a listening location, each of said main speakers comprising a driver and a tweeter with the tweeter spaced further from the listening location than the respective driver and separated from the respective driver by a first predetermined distance;

disposing right and left sub-speakers each consisting of only a driver at locations spaced respectively from the right and left main speaker locations so as to be further from the listening location than the main speaker locations by a second predetermined distance from respective main speaker locations;

coupling the right and left channel outputs to the respective right and left main speakers by crossover networks for effecting transition between drivers and tweeter at a sound frequency of approximately 1 kHz;

coupling the left channel output minus the right channel output to the left sub-speaker and the right channel output minus the left channel output to the right sub-speaker;

limiting the acoustic output of said subspeakers to midrange and lower frequencies.

7. A method in accordance with claim 6 wherein the second predetermined distance is approximately 7 to 12 inches.

8. A method in accordance with claim 6 wherein the first predetermined distance is approximately 4 to 7.5 inches.

9. In a stereophonic sound reproduction system having a left channel output and a right channel output, apparatus for reproducing sound having a realistic ambient field and acoustic image comprising:

right and left main speakers disposed respectively at right and left main speaker locations equidistantly spaced from a listening location;

right and left sub-speakers spaced respectively from said right and left main speakers so as to be further from the listening location than the main speakers;

means for coupling the right and left channel outputs to said right and left main speakers and means for coupling the left channel output minus the right channel output to said left sub-speaker and the right channel output minus the left channel output to said right sub-speaker; and means for limiting the acoustic output of said subspeakers to midrange and lower frequencies.

* * * * *